US009924284B2

(12) United States Patent
Morant et al.

(10) Patent No.: US 9,924,284 B2
(45) Date of Patent: Mar. 20, 2018

(54) METHOD OF ADAPTING A HEARING DEVICE TO A USER'S EAR, AND A HEARING DEVICE

(71) Applicants: Oticon A/S, Smørum (DK); Bernafon AG, Berne (CH)

(72) Inventors: Fabian Morant, Berne (CH); Stefan Stegmann Jensen, Smørum (DK)

(73) Assignees: OTICON A/S, Smørum (DK); BERNAFON AG, Berne (CH)

( * ) Notice: Subject to any disclaimer, the term of this patent is extended or adjusted under 35 U.S.C. 154(b) by 84 days.

(21) Appl. No.: 15/054,928

(22) Filed: Feb. 26, 2016

(65) Prior Publication Data

US 2016/0255448 A1 Sep. 1, 2016

(30) Foreign Application Priority Data

Feb. 27, 2015 (EP) ..... 15156955

(51) Int. Cl.
*H04R 25/00* (2006.01)
*H04R 29/00* (2006.01)

(52) U.S. Cl.
CPC ..... *H04R 25/70* (2013.01); *H04R 25/30* (2013.01); *H04R 25/305* (2013.01); *H04R 25/50* (2013.01); *H04R 25/554* (2013.01); *H04R 29/001* (2013.01); *H04R 2225/021* (2013.01);

(Continued)

(58) Field of Classification Search
CPC combination set(s) only.
See application file for complete search history.

(56) References Cited

U.S. PATENT DOCUMENTS 6,342,035 B1 * 1/2002 Kroll ..... H04R 25/606 600/25
2005/0105741 A1 * 5/2005 Niederdrank ..... H04R 25/70 381/60
2007/0036377 A1 2/2007 Stirnemann (Continued)

FOREIGN PATENT DOCUMENTS

EP 2 039 216 B1 9/2010
EP 2637423 A 9/2013

(Continued)

*Primary Examiner* — Amir Etesam
(74) *Attorney, Agent, or Firm* — Birch, Stewart, Kolasch & Birch, LLP

(57) ABSTRACT

The application relates to a hearing device comprising an input unit for providing an electric input audio signal, a configurable signal processing unit for processing an audio signal and providing a processed audio signal, and a reversible output transducer for converting an electric output signal to an acoustic output sound. The hearing device further comprises a measurement unit configured to convert a sound pressure level to an electric signal, termed the measurement signal, and a control unit configured to determine a present electric impedance of the output transducer or a measure indicative of said present electric impedance from said measurement signal. This has the advantage that no additional microphone or other measurement equipment is needed to provide a (e.g. in-situ) real ear measurement of sound pressure level. The invention may e.g. be used to control audio signal processing in hearing aids, headsets, ear phones, active ear protection systems, or combinations thereof.

21 Claims, 5 Drawing Sheets

(52) U.S. Cl.
CPC .... *H04R 2225/025* (2013.01); *H04R 2225/61* (2013.01); *H04R 2400/01* (2013.01)

(56) References Cited

U.S. PATENT DOCUMENTS

| | | | |
|---|---|---|---|
| 2007/0286441 | A1 | 12/2007 | Harsch et al. |
| 2015/0229353 | A1 | 8/2015 | Berthelsen et al. |

FOREIGN PATENT DOCUMENTS

| | | | |
|---|---|---|---|
| EP | 2 779 688 | A1 | 9/2014 |
| WO | WO 2010/083888 | A1 | 7/2010 |

* cited by examiner

METHOD OF ADAPTING A HEARING DEVICE TO A USER'S EAR, AND A HEARING DEVICE

TECHNICAL FIELD

The present application relates to hearing devices, in particular to the adaptation of a hearing device to a specific user, e.g. to the adaptation of gain to provide a requested sound pressure at an ear of a user. The application furthermore relates to the use of a hearing device, to a method of operating a hearing device, and to a combined system comprising a hearing device and a programming device.

Embodiments of the disclosure may e.g. be useful in applications such as hearing aids, headsets, ear phones, active ear protection systems, or combinations thereof.

BACKGROUND

There is an uncertainty about the sound pressure produced by a hearing instrument when located at or in an individual user's ear. The uncertainty arises from the a priori unknown individual ear characteristics. Individual ears can differ in the geometrical shape and volume of the ear canal and the properties of the tympanic membrane. These factors influence the acoustical behaviour of the ear when it is stimulated by a hearing instrument.

Current solutions to decrease this uncertainty are to measure the individual ear's characteristics prior to or during a hearing aid fitting with external measuring equipment. The first approach uses the so-called real-ear-to-coupler difference (RECD) as a measure of how an individual ear differs from a standard ear, e.g. represented by a standard 2 cc-coupler. This difference is then accounted for during the fitting of a hearing instrument. The second approach uses real time monitoring of the sound pressure in the individual ear when the hearing instrument is inserted into the ear (real ear measurements, REM). The monitoring is e.g. done via a small probe tube inserted into the ear and connected to a microphone of the external measuring equipment.

Both approaches use additional measuring equipment and require additional, time—consuming steps to be performed during a hearing instrument fitting. In addition, they suffer from translational errors because the measurement conditions do not fully correspond to real wearing conditions. In the RECD approach, it is assumed that the hearing aid behaves the same way as the measurement transducer used during RECD measurement, and in the REM approach, the probe tube creates acoustical leakage not present in real wearing conditions.

Further, when placing a hearing device comprising a loudspeaker (receiver) in the ear (RITE), the placement in the ear canal of the loudspeaker can vary from time to time, and may therefore create different resonances in the audio band. This will create a "different" acoustic fitting each time the hearing device is mounted in the ear.

US2007036377A1 describes a hearing instrument comprising at least one inner microphone operable to determine a sensing signal representative of an acoustic signal at a position in front of the user's eardrum. The inner microphone creates a sensing signal representative of the acoustic signal, and the signal processing unit of the hearing instrument determines a characteristic of the user's ear canal based thereon and memorizes values indicative of the characteristic. According to a preferred embodiment, the characteristic is an acoustic coupling transfer characteristic, which is determined based on a comparison of a signal representative of the output signal of the signal processing unit's digital signal processing stage and the sensing signal.

EP2039216B1 relates to a method for monitoring a hearing device comprising an electroacoustic output transducer worn at a user's ear or in a user's ear canal, the method comprising: measuring the electrical impedance of the output transducer analyzing the measured electrical impedance of the output transducer in order to evaluate the status of the output transducer and/or of an acoustical system cooperating with the output transducer and outputting a status signal representative of the status of the output transducer and/or of the acoustical system cooperating with the output transducer.

SUMMARY

An object of the present application is to provide an improved fitting of a hearing device to a particular user. A further object of an embodiment of the disclosure is to provide a better fitting and/or an improved performance a hearing device.

Objects of the application are achieved by the invention described in the accompanying claims and as described in the following.

A Hearing Device:

In an aspect of the present application, an object of the application is achieved by a hearing device comprising an input unit for providing an electric input audio signal, a configurable signal processing unit for processing an audio signal and providing a processed audio signal, and an output transducer for—in a normal mode of operation—converting an electric output signal to an acoustic output sound. The hearing device is adapted to provide that the output transducer is reversible, and the hearing device further comprises

- a measurement unit configured—at least in a specific measurement mode—to convert a sound pressure level to an electric signal, termed the measurement signal, and
- a control unit configured to determine a present electric impedance of the output transducer or a measure indicative of said present electric impedance from said measurement signal.

The present electric impedance of the output transducer is indicative of a present acoustic load of the output transducer (represented by the acoustic environment (e.g. a specific volume, form, reflecting surfaces, and properties thereof) that the transducer is exposed to.

The suggested solution has several advantages over the existing ones:

- No additional microphone needed
- No additional measurement equipment needed
- True in-situ measurement with the hearing instrument itself.
- No additional measurement step during fitting necessary, the measurement can be made during normal operation by the hearing instrument using the natural input signals picked up by the microphone(s) of the hearing instrument.

The concept of reversible transducers (e.g. loudspeakers) is dealt with in several textbooks on loudspeakers, e.g. in [Borwick; 2001], cf. section 16, *Terminology*, and in particular section 16.2.2. *Systems and their elements*. A reversible transducer will function with net energy flow in either direction through it (but not necessarily with equal efficiency in both directions). Typical acoustic transducers for hearing aids (e.g. from Knowles or Sonion) are reversible.

In an embodiment, the present electric impedance (or the corresponding measure) is provided at a number discrete frequencies, e.g. at two or more frequencies.

This proposed scheme is equivalent to measuring the electrical impedance Z of the loudspeaker. The electrical impedance of the transducer depends on the acoustical load impedance $Z_{ac}$ by its reciprocity property. This means that the electrical impedance Z changes when the acoustical impedance $Z_{ac}$ changes. This is exactly what happens when the hearing instrument is inserted into an individual's ear canal: The acoustical impedance $Z_{ac}=Z_{ear}$ of the ear canal will influence the electrical impedance Z of the loudspeaker. Since each ear has different acoustical properties and therefore different acoustical impedances $Z_{ac}$, each ear will change the electrical impedance Z in a different way. Once the electrical impedance Z is known, the corresponding acoustical impedance $Z_{ac}$ can be determined. By knowing the acoustical impedance $Z_{ac}$ (and/or the transducer impedance Z during acoustical load), the sound pressure p resulting from an applied transducer voltage U can be determined ($p=g(Z_{ac},U)=f(Z,U)$, where Z is the electric impedance of the transducer when the acoustic load is $Z_{ac}$).

In an embodiment, the control unit is configured to evaluate a present placement of the hearing device (e.g. comprising a part with a loudspeaker located in an ear canal of a user, e.g. a receiver in the ear (RITE)—type hearing device). In an embodiment, the control unit is configured to correct (e.g. automatically correct) signal processing of the hearing device to account for a different (than intended) placement of the loudspeaker in the ear canal (e.g. by determining and applying update processing parameters (frequency dependent gains) in the signal processing unit based on the present electric impedance of the loudspeaker).

In an embodiment, the hearing device comprises a memory storing corresponding values of a specific acoustic load and the electric impedance of the output transducer when exposed to the specific acoustic load. In an embodiment, the acoustic load comprises a standard load, e.g. a standard coupler, e.g. a 2 cc standard coupler. In an embodiment, the control unit is configured to compare a present electric impedance of the output transducer with an electric impedance corresponding to a specific acoustic load (e.g. a standard load).

In an embodiment, the control unit is configured to determine update processing parameters for substituting presently used processing parameters in the configurable signal processing unit based on the comparison of present electric impedance of the output transducer with an electric impedance corresponding to a specific acoustic load.

In an embodiment, the control unit is configured to correct the applied gain of the hearing device for individual ear canals regardless of the style of the hearing device. In an embodiment, the present disclosure deals with estimating the acoustic pressure in the ear canal of a user from an electrical impedance measurement on the loudspeaker.

In an embodiment, the control unit (or a memory of the hearing device) comprises data characterizing the output transducer. In an embodiment, the control unit comprises a transfer matrix H for the output transducer when viewed as a two-port network, such transfer matrix constituting or forming part of the data characterizing the output transducer.

The electric impedance of the output transducer may be determined in any appropriate way. In an embodiment, the impedance measurement is based on an impedance bridge. This provides a classic, robust, known way of determining an impedance. Thereby corresponding values of electric impedance and acoustic load can be recorded (e.g. during manufacture of the output transducer) and stored in a memory of the hearing device (e.g. during fitting of the hearing device).

In an embodiment, the control unit is configured to determine an estimate of a present sound pressure based on the measurement signal and the present electric impedance of the output transducer or a measure indicative of the present electric impedance. In an embodiment, such estimate is performed during use of the hearing device, e.g. implemented as part of a start-up procedure, and/or initiated via a user interface, e.g. a remote control, such as a smartphone, and/or performed with a (e.g. configurable frequency, e.g. once every hour, or once every week). Thereby, processing parameters can be updated to the present (load) conditions in the ear canal as appropriate. In an embodiment, such estimate is performed as part of a fitting procedure, e.g. while the hearing device is connected to a fitting system for customizing parameters of the hearing device to a particular user's needs.

The sound pressure p can be measured in absolute terms (e.g. Pa or μPa) or in relative terms, as a sound pressure level (SPL) (e.g. defined as $20 \log_{10}(p/p_0)$ dB SPL, where the reference pressure $p_0$ is equal to 20 μPa).

A particular person's hearing loss is (partly) defined by a hearing loss vs. frequency curve (the audiogram) describing, at each frequency, the (increased) hearing threshold of the hearing impaired person relative to the hearing threshold of a (typical) normally hearing person at that frequency (e.g. expressed in dB HL). Based on the hearing loss data (and possibly corresponding uncomfortable level data, etc.), a fitting algorithm (e.g. NAL-R, DSL i/o, etc.) may be used to prescribe specific amplification characteristics (gain versus frequency, preferably at different input levels) to compensate for the hearing loss of the person. The prescribed specific amplification characteristics are typically expressed as resulting prescribed (frequency dependent) sound pressure (or sound pressure level) in a standard acoustic coupler (e.g. a 2 cc coupler, having a volume of 2 $cm^3$) for a given input sound level (e.g. corresponding to a typical conversation, e.g. around 60-70 dB SPL). As mentioned above, the gains to be applied to an electric input signal of the hearing device in order to create the prescribed sound pressure levels may be 'translated' to a particular user's ear canal by a real ear measurement (e.g. during fitting of the hearing aid to the person) and a subsequent real ear to coupler difference (RECD) compensation of the applied gain. Thereby the prescribed sound pressure may be provided by the actual transducer of the hearing aid when located in the actual ear canal of the user.

The proposed solution estimates the ear canal sound pressure level with the loudspeaker of the hearing aid by using it as a microphone. The hearing aid loudspeaker is a reciprocal (or reversible) transducer, which means that it can convert energy in both directions from electrical to mechanical and from mechanical to electrical. Therefore, any sound pressure applied to the loudspeaker's acoustical port will induce a current through the electrical ports of the loudspeaker. The relationship between the applied sound pressure and the electrical current is a property of the transducer (e.g. a loudspeaker) and assumed to be known or determinable. Hence, by measuring the electrical current through the loudspeaker, the sound pressure in the ear canal can be deduced. In an embodiment, the measurement signal is equal to the current through the electrical ports of the loudspeaker (or an equivalent signal derivable therefrom).

The parameter that can be used as a fitting parameter is the estimated real ear pressure. The fitting itself usually requires the sound pressure to be a specific target pressure (derived from a fitting rationale or imposed by a hearing care professional (HOP)). The difference between the estimated real ear pressure and the target pressure can be used to adjust the gain in the signal processing unit to achieve a better match to the required pressure in the ear canal.

The determination of the sound pressure from the impedance uses e.g. a two-port network modeling of the transducer and acoustical tubes (see e.g. FIG. 1). Two-port modeling is mostly known from radio frequency electrical engineering, where any linear network accessible by two ports can be modeled with four characteristic quantities. These quantities are usually arranged into matrices of several kinds. In an embodiment, the proposed solution makes use of the transfer matrix representation, which allows simple enchainment of succinct two-port networks.

In an embodiment, the hearing device comprises a memory storing a target sound pressure, or a measure thereof, intended to be applied to the user's ear drum to compensate for a hearing impairment of the user. In an embodiment, the target sound pressure is provided at a number discrete frequencies, e.g. at two or more frequencies, and at a number of levels (e.g. two or more levels) of a sound input reflected in the electric input audio signal from the input unit.

In an embodiment, the control unit is configured to compare the estimate of present sound pressure or a measure thereof with the target sound pressure or a measure thereof and to provide a comparison result. In an embodiment, the control unit is configured to check whether the result of the comparison of present and target sound pressure (or corresponding measures) fulfil a predefined criterion (e.g. indicating whether the present and target sound pressures (or corresponding measures) deviate by more than a predefined absolute or relative amount).

In an embodiment, the control unit is configured to determine update processing parameters for substituting presently used processing parameters in the configurable signal processing unit from the estimate of present sound pressure. In an embodiment, the control unit is configured to determine the update processing parameters to provide that the future (present) sound pressure (after the update parameters have been applied to the signal processing unit) is closer (preferably equal) to the target sound pressure than prior to the update. In an embodiment, the control unit is configured to apply the update processing parameters to the configurable signal processing unit. In an embodiment, the control unit is configured to determine the update processing parameters in dependence of the comparison result. In an embodiment, the control unit is configured to apply the update processing parameters to the configurable signal processing unit in dependence of the comparison result.

In an embodiment, the hearing device comprises a communication interface to a programming device for fitting processing parameters of the hearing device to a particular user. In an embodiment, the hearing device is configured to allow the specific measurement mode to be controlled from the fitting system. In an embodiment, the hearing device is configured to allow a transfer of data to and from the programming device. In an embodiment, the hearing device is configured to allow a transfer of the measurement signal (or a parameter derived therefrom, e.g. the present electric impedance of the transducer) from the hearing device to the programming device.

In an embodiment, the hearing device comprises a user interface allowing the specific measurement mode to be controlled from the user interface. In an embodiment, the user interface comprises an activation element on the hearing device. In an embodiment, the hearing device comprises a communication interface to another (auxiliary) device (e.g. other than a programming device). In an embodiment, the user interface is implemented by a separate (auxiliary) device comprising a communication interface to the hearing device. In an embodiment, the user interface is implemented in a remote control device, e.g. forming part of a communication device, such as a cellular telephone, e.g. a SmartPhone. In an embodiment, the user interface is fully or partially implemented as an APP running on a SmartPhone.

In an embodiment, the control unit is configured to present a comparison result to a user via the user interface. In an embodiment, the hearing device is configured to present data relating to the measurement of electric impedance of the output transducer via the user interface. In an embodiment, the hearing device is configured to allow a user to influence a course of action drawn from the measurement of electric impedance of the output transducer (e.g. to influence a decision regarding the function of the hearing device). In an embodiment, the hearing device is configured to allow a user to choose between a number of proposed actions presented to the user via the user interface. In an embodiment, the number of proposed actions include 'to modify the mounting of the hearing device' (to modify (e.g. improve) its fitting to the ear canal).

In an embodiment, the hearing device comprises a hearing aid, a headset, an ear phone, an active ear protection systems, or a combination thereof.

In an embodiment, the hearing aid is of the 'receiver in the ear type' (RITE), where a loudspeaker (receiver) is located in the ear canal of the user in a relatively open fitting, e.g. guided by a relatively open guiding element (e.g. a rigid or semi-rigid dome-like structure). In an embodiment, the hearing aid comprises a (e.g. custom made) mould part adapted for being located in the ear canal of the user and for forming a relatively tight fir to the walls of the ear canal (to enable a relatively large sound pressure level to be delivered by the loudspeaker at the ear drum of the user).

In an embodiment, the loudspeaker of the hearing device is configured to play a specific audio sequence of tones (e.g. the same as a startup jingle), and measuring the current used by the loudspeaker at these specific tones, you can determine the load of the ear and therefore the transfer function of the ear canal.

In an embodiment, the configurable signal processing unit is adapted to provide a frequency dependent gain and/or a level dependent compression and/or a transposition (with or without frequency compression) of one or frequency ranges to one or more other frequency ranges, e.g. to compensate for a hearing impairment of a user. Various aspects of digital hearing aids are described in [Schaub; 2008].

The hearing device comprises an output transducer. In an embodiment, the output transducer comprises a loudspeaker (often termed 'receiver' in connection with hearing aids) for providing the stimulus as an acoustic signal to the user. In an embodiment, the output transducer comprises a vibrator for providing the stimulus as mechanical vibration of a skull bone to the user (e.g. in a bone-attached or bone-anchored hearing device). In an embodiment, the output transducer is specifically adapted to be sensitive to different acoustic loads (to ease the measurement of impedance changes; e.g. by creating a larger change in impedance for a given change in pressure). In an embodiment, output transducer comprises a loudspeaker comprising a diaphragm. In an embodiment, the diaphragm comprises graphene. This has the advantage of being efficient in that almost all the (electric) energy that drives the diaphragm is turned into (acoustic energy) sound.

The hearing device comprises an input unit. In an embodiment, the hearing device comprises an input transducer for converting an input sound to an electric input signal. In an embodiment, the hearing device comprises a directional microphone system adapted to enhance a target acoustic source among a multitude of acoustic sources in the local environment of the user wearing the hearing device. In an embodiment, the directional system is adapted to detect (such as adaptively detect) from which direction a particular part of the microphone signal originates. This can be achieved in various different ways as e.g. described in the prior art.

In an embodiment, the hearing device is portable device, e.g. a device comprising a local energy source, e.g. a battery, e.g. a rechargeable battery.

In the present context, a 'hearing device' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear.

The hearing device may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing device may comprise a single unit or several units communicating electronically with each other.

More generally, a hearing device comprises an input transducer for receiving an acoustic signal from a user's surroundings and providing a corresponding input audio signal and/or a loudspeaker for electronically (i.e. wired or wirelessly) receiving an input audio signal, a signal processing circuit for processing the input audio signal and an output means for providing an audible signal to the user in dependence on the processed audio signal. In some hearing devices, an amplifier may constitute the signal processing circuit. In some hearing devices, the output means may comprise an output transducer, such as e.g. a loudspeaker for providing an air-borne acoustic signal or a vibrator for providing a structure-borne or liquid-borne acoustic signal.

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window.

In an embodiment, the hearing device further comprises other relevant functionality for the application in question, e.g. feedback suppression, compression, noise reduction, etc.

In an embodiment, the hearing device comprises a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof.

Use:

In an aspect, use of a hearing device as described above, in the 'detailed description of embodiments' and in the claims, is moreover provided. In an embodiment, use is provided in a programming device (e.g. a fitting system) to determine an appropriate gain to provide a prescribed sound pressure level in the ear canal of a user when wearing the hearing device. In an embodiment, use of the hearing device to determine a sound pressure of the output transducer of the hearing device when located in a user's ear canal is provided.

A Combined System:

In an aspect, a combined system comprising a programming device (e.g. a fitting system) for fitting processing parameters of a hearing device to a particular user and a hearing device as described above, in the 'detailed description of embodiments' and in the claims, is moreover provided.

A Method:

In an aspect, A method of operating a hearing device, the method comprising

- providing an electric input audio signal,
- processing an audio signal originating from the electric input audio signal, and providing a processed audio signal, and
  - in a normal mode of operation—using an output transducer to convert an electric output signal originating from the processed audio signal to an acoustic output sound is furthermore provided by the present application.

The method further comprises

- in a specific measurement mode—
  - using the output transducer to convert a sound pressure level to an electric signal, termed the measurement signal, and
  - determining a present electric impedance of the output transducer or a measure indicative of said present electric impedance from said measurement signal.

It is intended that some or all of the structural features of the device described above, in the 'detailed description of embodiments' or in the claims can be combined with embodiments of the method, when appropriately substituted by a corresponding process and vice versa. Embodiments of the method have the same advantages as the corresponding devices.

In an embodiment, the method comprises

- determining update processing parameters from said present electric impedance,
- substituting presently used processing parameters with said update processing parameters for use in said processing of the audio signal, if said estimate of present sound pressure fulfils a predefined criterion.

In an embodiment, the method comprises

- analyzing said present electric impedance,
- providing a number of proposed actions to the use via a user interface,
- allowing the user to choose an action from said number of proposed actions via said user interface.

In an embodiment, the method comprises providing data characterizing said output transducer;

determining an estimate of a present sound pressure based on said measurement signal, said data characterizing said output transducer; and said present electric impedance of the output transducer or a measure indicative of said present electric impedance.

The electric impedance of the output transducer may be determined in any appropriate way. In an embodiment, the impedance measurement is based on an impedance bridge. This provides a classic, robust, known way of determining an impedance. In an embodiment, corresponding values of electric impedance and acoustic load of the output transducer are recorded and stored in a memory of the hearing device.

In an embodiment, the method comprises comparing the estimate of present sound pressure or a measure thereof with a target sound pressure or a measure thereof and to provide a comparison result. In an embodiment, the method comprises checking whether the comparison result fulfils the predefined criterion. In an embodiment, the predefined criterion comprises an expression defining whether the present and target sound pressures (or corresponding measures) deviate by more than a predefined absolute or relative amount.

In an embodiment, the estimate of a present sound pressure based on the measurement signal and the present electric impedance of the output transducer or a measure indicative of the present electric impedance. In an embodiment, such estimate is performed during use of the hearing device, e.g. implemented as part of a start-up procedure, and/or initiated via a user interface, e.g. a remote control, such as a smartphone, and/or performed with a (e.g. configurable frequency, e.g. once every hour, or once every week). In an embodiment, such estimate is performed as part of a fitting procedure, e.g. while the hearing device is connected to a fitting system for customizing parameters of the hearing device to a particular user's needs.

Definitions

In the present context, a 'hearing device' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing device may comprise a single unit or several units communicating electronically with each other.

More generally, a hearing device comprises an input transducer for receiving an acoustic signal from a user's surroundings and providing a corresponding input audio signal and/or a receiver for electronically (i.e. wired or wirelessly) receiving an input audio signal, a signal processing circuit for processing the input audio signal and an output means for providing an audible signal to the user in dependence on the processed audio signal. In some hearing devices, an amplifier may constitute the signal processing circuit. In some hearing devices, the output means may comprise an output transducer, such as e.g. a loudspeaker for providing an air-borne acoustic signal or a vibrator for providing a structure-borne or liquid-borne acoustic signal. In some hearing devices, the output means may comprise one or more output electrodes for providing electric signals.

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory cortex and/or to other parts of the cerebral cortex.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. SmartPhones), public-address systems, car audio systems or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

Figure 1A:
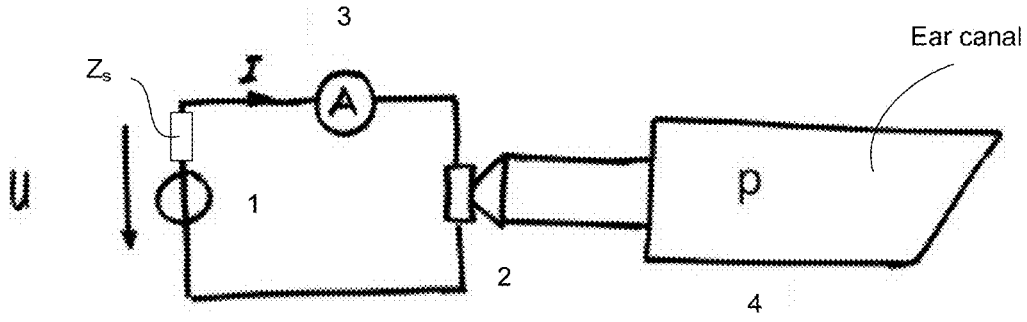
FIG. 1A and FIG. 1B show an embodiment of a measurement circuit for estimating an impedance of an output transducer of a hearing device when the hearing device is operationally located at an ear of a user (FIG. 1A) and a two-port network model of the output transducer.

FIG. 1A shows an example of a model implementation of the real ear measurement of sound pressure level according to the present disclosure. FIG. 1A schematically shows the principle components involved:

(1). Electrical output stage of the hearing device modeled as a real voltage source with internal impedance $Z_s$ (providing voltage U).

(2). Receiver (loudspeaker) including possible acoustical tubing.

(3). Current measuring device (A) (providing current I).

(4). Ear canal with sound pressure p and ear drum (upwards sloping line at the right end of the Ear canal).

Figure 3:
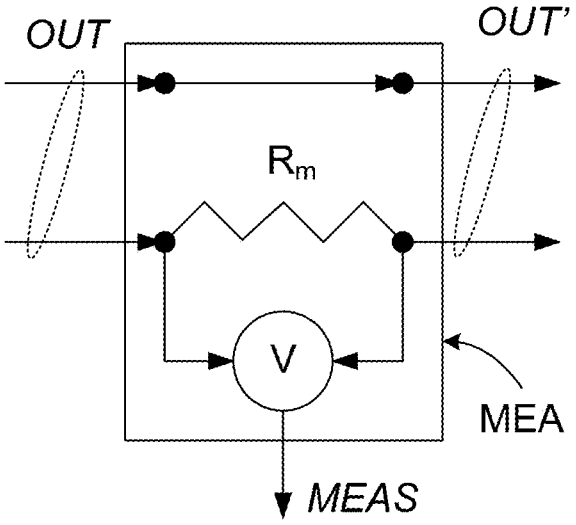
FIG. 3 shows an embodiment of a measurement circuit for estimating an impedance of an output transducer of a hearing device.

The current measuring device (3) on a hearing instrument amplifier can be implemented by inserting a series resistor and measuring the voltage across it (cf. FIG. 3). The voltage can be measured with one of the auxiliary inputs of the amplifier.

There is a variety of impedance measurements available in the literature. In the present disclosure, a relatively simple one is described to illustrate the concept. There are certainly other methods available, e.g. using bridge circuits (Wheatstone bridge), that may perform better in practice.

Figure 1B:
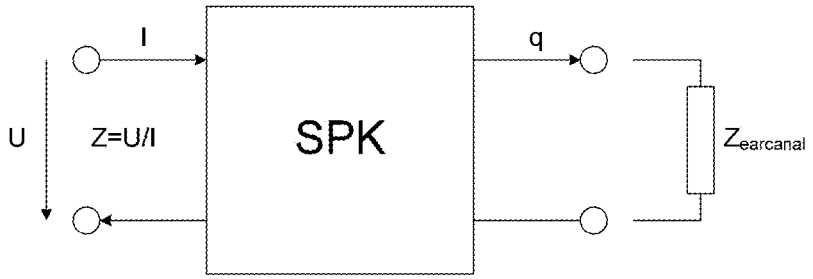

FIG. 1B illustrates a two-port network model of the output transducer (SPK).

If H is the transfer-matrix of the transducer and $Z_{ear}$ the acoustical impedance of the ear canal, the pressure p resulting from a voltage U applied to the loudspeaker is then given by:

$$p = \frac{(H_{12} - H_{22} \cdot Z_{ear})}{(H_{12} \cdot (H_{21} \cdot Z_{ear} - H_{11}) + H_{11} \cdot (H_{12} - H_{22} \cdot Z_{ear})} \cdot U$$

where H is the transducer transfer matrix:

$$H = \begin{pmatrix} H_{11} & H_{12} \\ H_{21} & H_{22} \end{pmatrix}$$

Note that all quantities are complex functions of frequency.

A practical issue is that the reverse sensitivity (acoustic to electric conversion) of the transducer is typically low (compared to the sensitivity of its original purpose, electric to acoustic) resulting in relatively small changes in the electrical impedance. In an embodiment, the output transducer and/or the acoustical tubing (possibly) connected to the output transducer is adapted in order to improve the reverse sensitivity.

Two Port Model of a Loudspeaker with Acoustic Load:

The derivation of the ear canal sound pressure from the electrical impedance is done in three steps:

1. Estimate ear canal pressure with known acoustical impedance
2. Estimate acoustical impedance from electrical impedance
3. Combine the two steps to get a pressure estimation from electrical impedance measurement Estimate Ear Canal Pressure with Known Acoustical Impedance When the ear canal impedance is known, then the pressure can be determined from the applied voltage U by [Philippow; 1986], volume 1, Chapter 2.15, page 380:

$$p = G_p U = \frac{Z_{ear}}{H_{12} + H_{11} Z_{ear}} U$$

where $$H = \begin{pmatrix} H_{11} & H_{12} \\ H_{21} & H_{22} \end{pmatrix}$$

is the transfer function matrix of the loudspeaker which is known.

All quantities are complex functions of frequency, i.e. but not shown for more clarity.

$$H_{11} = h_{11}(f) e^{j\varphi(f)}$$

Estimate Acoustical Impedance from Electrical Impedance Measurement

The relation between electrical and acoustical quantities expressed in matrix notation is:

$$\begin{pmatrix} U \\ I \end{pmatrix} = H \begin{pmatrix} p \\ q \end{pmatrix} = \begin{pmatrix} H_{11} & H_{12} \\ H_{21} & H_{22} \end{pmatrix} \begin{pmatrix} p \\ q \end{pmatrix}$$

By solving for the acoustical quantities pressure p and volume velocity q, we can write the acoustical impedance in terms of the electrical impedance:

$$\begin{pmatrix} p \\ q \end{pmatrix} = H^{-1} \begin{pmatrix} U \\ I \end{pmatrix} = \begin{pmatrix} H_{22} & -H_{12} \\ -H_{21} & H_{11} \end{pmatrix} \begin{pmatrix} U \\ I \end{pmatrix}$$

Where Z=U/I is the electrical impedance of the loudspeaker, and $Z_{ear}$ is the acoustical impedance of the ear canal:

$$Z_{ear} = \frac{p}{q} = \frac{H_{22} U - H_{12} I}{-H_{21} U + H_{11} I} = \frac{H_{22} Z - H_{12}}{-H_{21} Z + H_{11}}$$

Combine the Expressions for the Ear Canal Impedance and the Pressure Estimation

Combining the expressions for the ear canal impedance and the pressure estimation yields:

$$p = \frac{H_{22} - H_{12} Z^{-1}}{\det(H)} U$$

So the pressure p in the ear canal can be determined from the applied voltage U and the electrical impedance Z of the output transducer (p=f(Z,U)). It is assumed that characteristics of the transducer are known, and that the electrical impedance Z is determined from the applied voltage U and the measured current I.

Figure 2A:
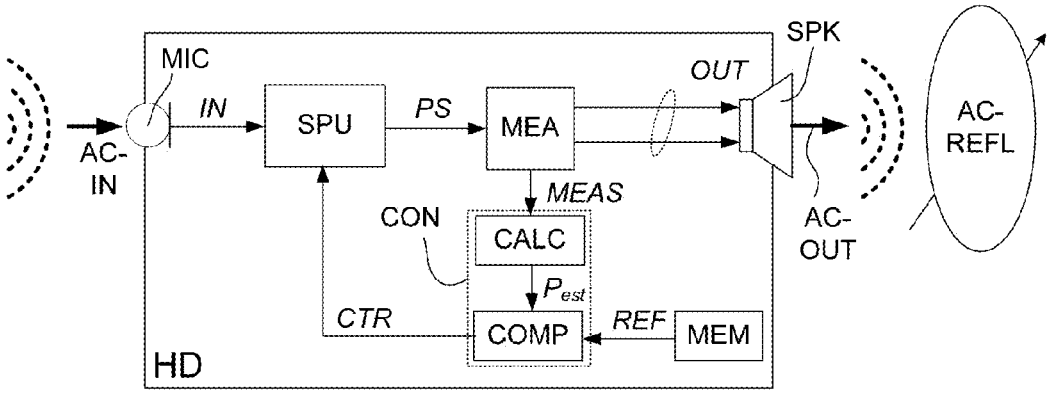
FIG. 2A and FIG. 2B show two exemplary embodiments (FIG. 2A and FIG. 2B) of a hearing device according to the present disclosure.
Figure 2B:
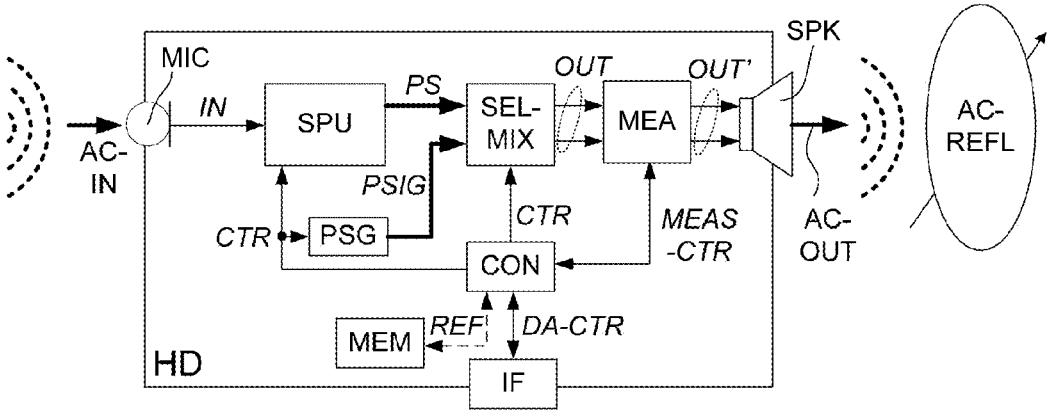

FIG. 2 shows two exemplary embodiments (FIG. 2A and FIG. 2B) of a hearing device (HD) according to the present disclosure. Both embodiments comprise an input unit for providing an electric input audio signal IN, here in the form of a microphone (MIC) for converting an input sound AC-IN to an electric input audio signal IN. The hearing device further comprises a configurable signal processing unit (SPU) for processing an audio signal IN and providing a processed audio signal PS, and an output transducer, here in the form of a loudspeaker (SPK), for—in a normal mode of operation—converting an electric output signal to an acoustic output sound AC-OUT. The signal processing unit (SPU) is configured to apply a frequency and/o level dependent gain to the electric input audio signal IN to compensate for a use's hearing impairment. The processed signal PS is preferably provided with an output voltage swing U aiming at being applied to the output transducer (SPK, in the form of signal OUT) and to thereby provide a prescribed sound pressure (of sound signal AC-OUT) at the user's ear drum, when the hearing device is appropriately located at the ear and/or in the ear canal of the user. The ear drum is together with the ear canal denoted AC-REEL in FIG. 2 (where the arrow is intended to indicate a variable acoustic load of the loudspeaker of the hearing device provided by the ear canal). A forward path for processing the electric input audio signal IN and providing the electric output signal OUT to the output transducer (SPK) is defined between the input unit (IU) and the output transducer (SPK). The output transducer (SPK) is adapted to be reversible, in the sense that, any sound pressure applied to the loudspeaker's acoustical port will induce a current through the electrical ports of the loudspeaker (so that for example a change in acoustic load of the loudspeaker is reflected in a change in the current drawn by the loudspeaker). The hearing device (HD) further comprises a measurement unit (MEA) configured—at least in a specific measurement mode—to convert a sound pressure level to an electric signal, termed the measurement signal, and a control unit (CON) configured to determine a present electric impedance Z of the output transducer (SPK) (or a measure indicative of said present electric impedance) from said measurement signal MEAS. The measurement unit (MEA) is located in the forward path between the signal processing unit (SPU) and the output transducer (SPK). The signal OUT for driving the loudspeaker is preferably a balanced signal (as indicated in FIG. 2 by the two arrows and dotted ellipse representing signal OUT). The hearing device further comprises a memory for storing a reference parameter, e.g. a reference sound pressure corresponding to a known acoustic load, and/or an electric impedance of the loudspeaker corresponding to a known acoustic load. The control unit (CON) is preferably configured to determine update processing parameters (signal CTR) for substituting presently used processing parameters in the configurable signal processing unit (SPU) based on a comparison of present electric impedance Z of the output transducer (SPK) with an electric impedance $Z_{ref}$ corresponding to a specific acoustic load, e.g. stored in the memory (MEM) or provided from another device via a communication interface (cf. e.g. interface unit (IF) in FIG. 2B).

FIG. 2A shows an embodiment of a hearing device (HD) as described above, wherein the control unit comprises a calculation unit (CALC) for determine an estimate of a present sound pressure $P_{est}$ in the acoustic load volume of the loudspeaker (e.g. the ear canal of the user). The estimate of present sound pressure $P_{est}$ is based on the measurement signal MEAS and on data characterizing the output transducer (such data being e.g. stored in advance of the use of the hearing device in memory (MEM), as e.g. determined during a fitting session, or provided by a manufacturer). In an embodiment, the measurement unit (MEA) provides data indicative of a currently applied voltage U and the corresponding current I drawn by the loudspeaker (e.g. at measured at different frequencies). Thereby a present impedance Z of the loudspeaker can be determined. The control unit (CON) further comprises comparison unit (COMP) configured to compare the estimate of present sound pressure $P_{est}$ provided by calculation unit (CALC) with a sound pressure $P_{ref}$ corresponding to a specific acoustic load (e.g. a standard load, e.g. a 2 cc standard coupler) and stored in the memory (MEM). The control unit is further configured to determine update processing parameters (signal CTR) for substituting presently used processing parameters in the configurable signal processing unit (SPU) based on the estimate of present sound pressure $P_{est}$ (possibly in dependence of the result of the comparison with reference sound pressure $P_{ref}$).

Figure 4:
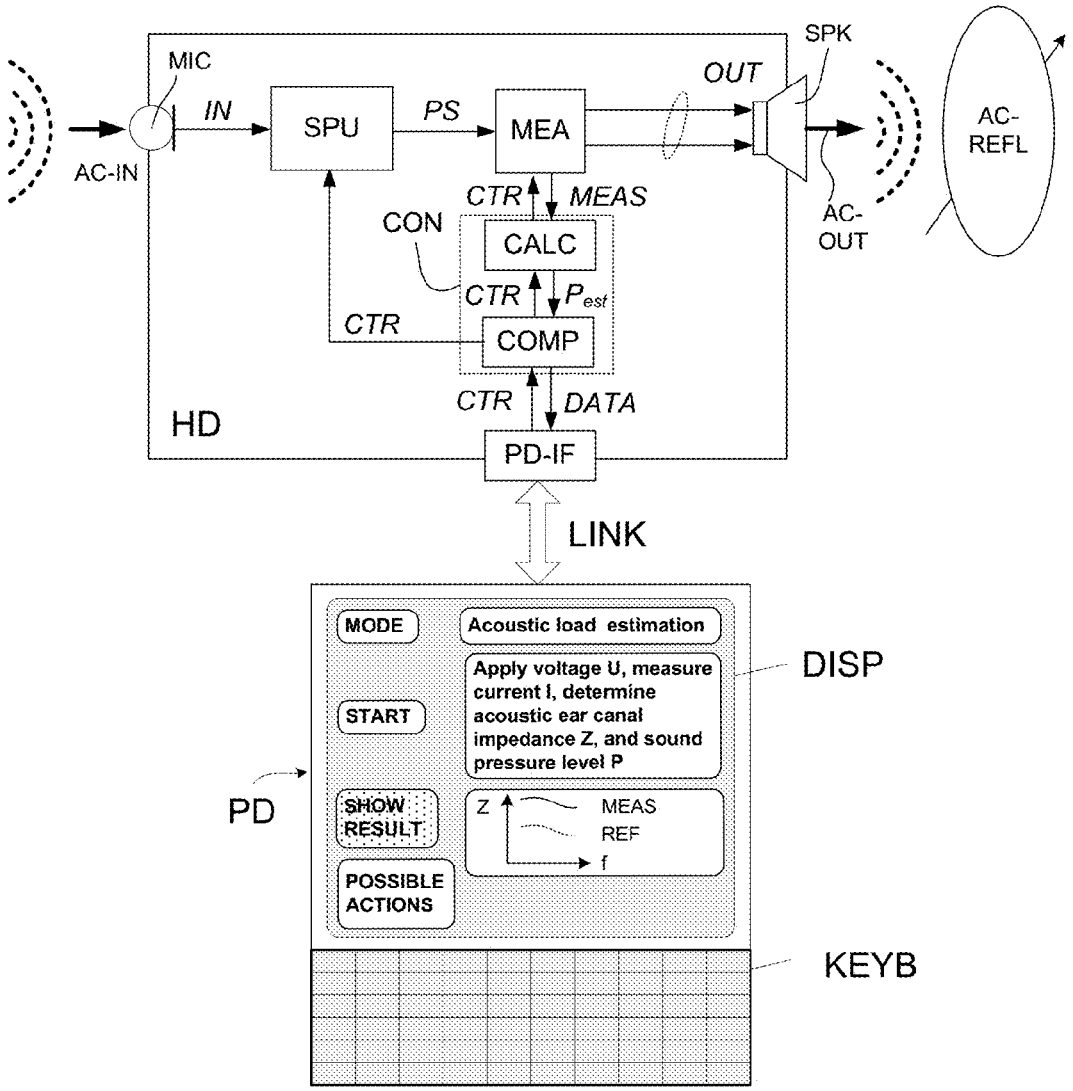
FIG. 4 shows an embodiment of a hearing system comprising a hearing device according to the present disclosure and a programming device operationally connected to the hearing device via a communication link.
Figure 5:
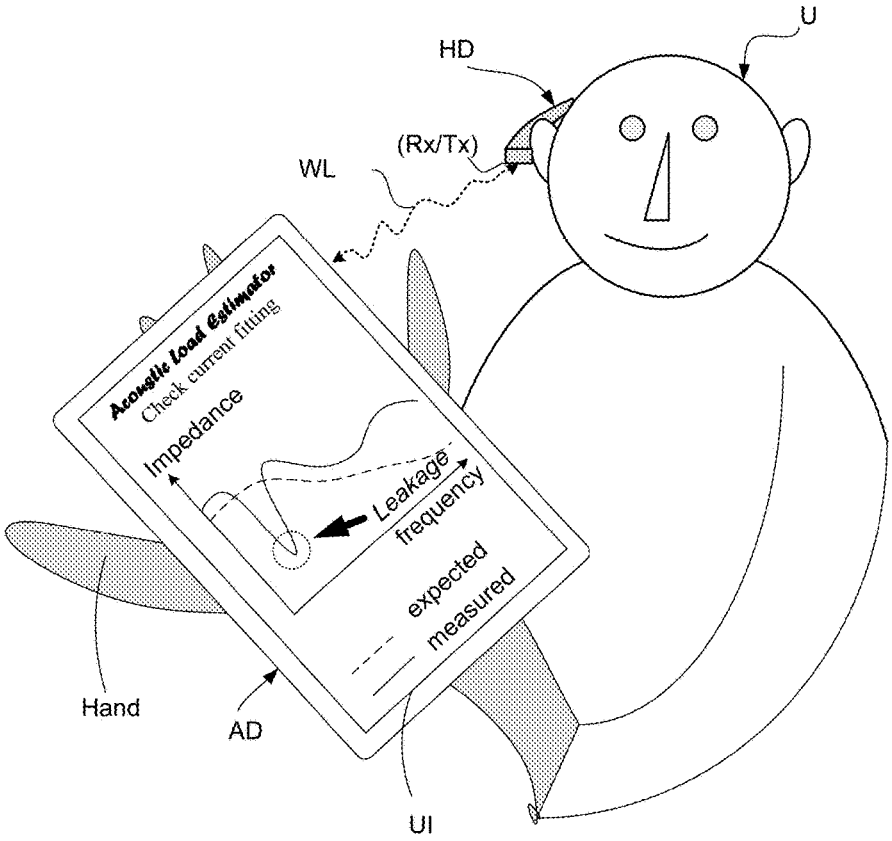
FIG. 5 shows an APP for initiating and/or presenting results of an acoustic load measurement in the hearing device according to an embodiment of the present disclosure.

FIG. 2B shows an embodiment of a hearing device (HD) as described above, but further comprising a communication interface (IF) to a programming device (cf. PD in FIG. 4, e.g. comprising a fitting system for fitting processing parameters of the hearing device to a particular user) and/or to a remote control (or auxiliary) device (cf. AD in FIG. 5). The communication interface (IF) is intended to allow the exchange of data between the hearing device (HD) and the other device(s) (programming device (cf. PD in FIG. 4), auxiliary device (cf. AD in FIG. 5)), e.g. including that the hearing device is configured to allow a specific measurement mode to be controlled from such other devices and/or that measurement results can be presented via and/or options for reactions to such results be selected from such devices.

The hearing device (HD) further comprises a probe signal generator (PSG) for generating a probe signal PSIG, which e.g. in the specific measurement mode can be used as an output signal OUT alone or mixed with a signal of the forward path (here the processed signal PS from the signal processing unit (SPU)) in a selection-mixing unit (SEL-MIX). The selection-mixing unit (SEL-MIX) is controllable via control signal CTR from the control unit (CON). The probe signal is configured to allow a determination of the electric impedance of the loudspeaker (SPK) in the specific measurement mode. In an embodiment, the probe signal PSIG comprises a number of pure tones at a number of different predetermined frequencies $f_i$, $i=1, 2, \ldots, N_F$, where NF is the number of different pure tones. The pure tones of the probe signal PSIG are e.g. played sequentially in time to allow an impedance of the loudspeaker to be determined at each frequency $f_i$. In an embodiment, the frequencies of the pure tones are e.g. identical to the typical frequencies used to measure a hearing loss of a use in an audiogram. In an embodiment, the predetermined frequencies comprise one or more, such as all, of $f_1$=250 Hz, $f_2$=500 Hz, $f_3$=1 kHz, $f_4$=2 kHz, $f_5$=4 kHz, $f_6$=8 kHz. In an embodiment, the probe signal comprises random signals (e.g. noise). In various embodiments, the probe signal comprises one or more of random noise, Maximum Length Sequence (MLS), multi-tones, pure tones, or combinations thereof.

In an embodiment, the hearing device comprises a user interface, allowing a user to control or influence functionality of the hearing device. In an embodiment, a user is at least able to control the specific measurement mode via the user interface. In an embodiment, the hearing device is configured to allow control of the hearing device via the communication interface (IF), so that a user interface can be implemented in an auxiliary device, e.g. a Smartphone, see e.g. FIG. 5. As indicated in the embodiment of a hearing device in FIG. 2B, the hearing device is controllable via the communication interface, cf. control signal DA-CTR for controlling the control unit (CON), and via the control unit for controlling the signal processing unit and the probe signal generator (PSG, cf. control signal(s) CTR), the selection-mixing unit (SEL-MIX, cf. control signal(s) CTR), and the measurement unit (MEA, cf. control signal MEAS-CTR).

The forward between the input unit (e.g. a microphone and/or direct electric input (e.g. a wireless receiver), here microphone (MIC)) and the output transducer (here loudspeaker (SPK)) may be operated fully or partially in the frequency domain (requiring appropriate time to frequency domain and frequency to time domain converters to be included in the forward path). The control path comprising functional components (e.g. control unit (CON)) for analyzing a signal of the forward path (e.g. the output signal OUT) and for controlling components of the forward path (e.g. the measurement unit (MEA) or the signal processing unit (SPU), etc.) may likewise be operated fully or partially in the frequency domain.

FIG. 3 shows an embodiment of a measurement circuit (MEA) for estimating an impedance of an output transducer of a hearing device. The measurement circuit (MEA) comprises a series resistor ($R_m$) in one of the two electrical conductors for transferring the signal OUT for driving the output transducer (as signal OUT). The measurement circuit (MEA) further comprises a voltage measuring unit (e.g. a voltmeter V) for measuring the voltage across the series resistor ($R_m$). The size of the series resistor ($R_m$) is chosen to 1) be sufficiently small so as not to significantly influence the normal audio signals to the output transducer and 2) be sufficiently large to provide an acceptable voltage drop by the current changes induced by expected changes in acoustical load impedance of the loudspeaker. In an embodiment, the measurement circuit (MEA) comprises controllable switches (controllable via control signal CTR from the control unit (CON) that only switch in the measurement resistor ($R_m$) when the hearing device is in the specific measurement mode.

FIG. 4 shows an embodiment of a hearing system comprising a hearing device (HD) according to the present disclosure and a programming device (PD) operationally connected to the hearing device via a communication link (LINK). The hearing device can be any hearing device according to the present disclosure comprising a communication interface (PD-IF) to a programming device (PD). In the embodiment of FIG. 4, the hearing device (HD) is as illustrated in FIG. 2A. In the hearing device of FIG. 4, the various functional units (SPU, MEA, CON) are controllable from the programming device (PD) via control signals CTR. On the other hand, one or more of measurement signal MEAS, estimated present sound pressure $P_{est}$ and the result of a comparison of present sound pressure $P_{est}$ with a reference sound pressure $P_{ref}$ is/are transferred to the programming device (PD) for further processing and presentation to a user of the programming device (e.g. a hearing care professional).

The programming device (PD) is configured to run a fitting software for customizing processing parameters of the hearing device to the needs of a particular user. The programming device comprises a use interface in the form of a keyboard (KEYB) and a display (DISP) allowing a hearing care professional to interact with the system and influence functionality of the hearing device. The exemplary display screen illustrates a situation where the hearing device (HD) is set into the specific measurement mode ('activation button' MODE indicates Acoustic load estimation). A measurement of present electric impedance Z of the loudspeaker (SPK) has been initiated (by activating button START). The corresponding information box indicates the measurement procedure: Apply voltage U, measure current I, determine acoustic ear canal impedance Z, and sound pressure level P. In the exemplary display screen, a graphical result of the measurement is currently being indicated (cf. shaded button SHOW RESULT) in the corresponding information box (cf. graph showing present loudspeaker impedance (MEAS) and reference loudspeaker impedance (REF) as a function of frequency f). A further activation button (POSSIBLE ACTIONS) is shown. This button may be activated to have a number of relevant (optional, proposed) actions displayed in a corresponding information box that will appear to the right of the button. Such potential actions may e.g. be A) to repeat the measurement, B) to remount the hearing device in an attempt to change the acoustic load of the loudspeaker of the hearing device, C) to allow a proposed change of processing parameters to be implemented in the signal processing unit, etc. By clicking on a chosen action this action is activated (A, C) or prepared (B).

FIG. 5 shows an APP for initiating and/or presenting results of an acoustic load measurement in the hearing device (HD) according to the present disclosure. FIG. 5 shows an embodiment of a hearing system comprising a hearing devices (HD) in communication with a portable (handheld) auxiliary device (AD) functioning as a user interface (UI) for the hearing device. In an embodiment, the hearing system comprises the auxiliary device (and the user interface). The exemplary screen of the 'Acoustic Load Estimator (check current fitting)' APP illustrates the results of a measurement of present estimate of loudspeaker impedance Z versus frequency. The APP is configured to (graphically) display the present estimate of loudspeaker impedance Z versus frequency (indicated in solid line, and reference measured) as measured and estimated by the hearing device (HD). Likewise a stored reference impedance Z versus frequency of the loudspeaker is indicated in the same graph (dashed graph denoted expected). In the exemplary APP screen shown in FIG. 5, the graph of present estimate of loudspeaker impedance Z versus frequency exhibits a conspicuous dip at relatively low frequencies (indicated as due to Leakage in the screen). This information may indicate to the use that a remounting of the hearing device is worthwhile. Alternatively, the use may accept the present estimate of loudspeaker impedance Z and allow the hearing device to update its processing parameters in an attempt to compensate for the differences in measured and expected impedance (with the aim of providing a sound pressure at the ear drum as prescribed by a fitting algorithm based on the use's hearing loss data).

The user interface (UI) is implemented as an APP of the auxiliary device (AD, e.g. a SmartPhone). In the embodiment of FIG. 5, the auxiliary device (AD) and the hearing device (HD) are adapted to establish a wireless link (WL) between them to allow exchange of relevant data between the use interface (UI) and the hearing device (HD). The wiles link may be implemented as a near-field communication (e.g. inductive) link or as a far-field communication (e.g. RF) link. The wireless interface is implemented in auxiliary and hearing devices (AD, HD) by respective antenna and transceiver circuitry (Rx/Tx) (only shown in the hearing device in FIG. 5). The auxiliary device (AD) comprising the user interface (UI) is adapted for being held in a hand (Hand) of a user (U), and hence convenient for displaying information regarding the present acoustic load of the hearing device.

In an embodiment, the hearing device (HD) is configured to start up (after a power-on), while still located in a hand of the user (or a caring person) and then placed on ear. The hearing device may be configured to immediately after power-on start measuring the impedance (e.g. by monitoring the current drawn from the loudspeaker or the voltage over the (e.g. a coil of) the loudspeaker during stimulation). The two 'extreme' situations represented by the hearing device being located either a) in a hand or on any other surface or b) mounted at an ear of the user, are typically sufficiently different to determine from the change of loudspeaker response (impedance), when the hearing device (loudspeaker) is in any of the two situations (a) open air or b) enclosed in a chamber (ear canal)).

Preferably, by the detection of the hearing device being operationally located at the ear of a user, the hearing device is configured to play predetermined sound or sounds, e.g. a jingle, e.g. similar to the startup jingle, where the loudspeaker impedance (e.g. a current draw of the loudspeaker) at each tone is monitored. By mapping these tones vs impedance (e.g. current), a transfer function of the ear canal can be determined, with that specific placement of the hearing device (loudspeaker).

Applying this transfer function to the gain curve stored in the hearing device, the HI will output a correct gain response, regardless of how the hearing aid was fitted.

Details of this process may be displayed and influenced via the use interface (UI).

Figure 6:
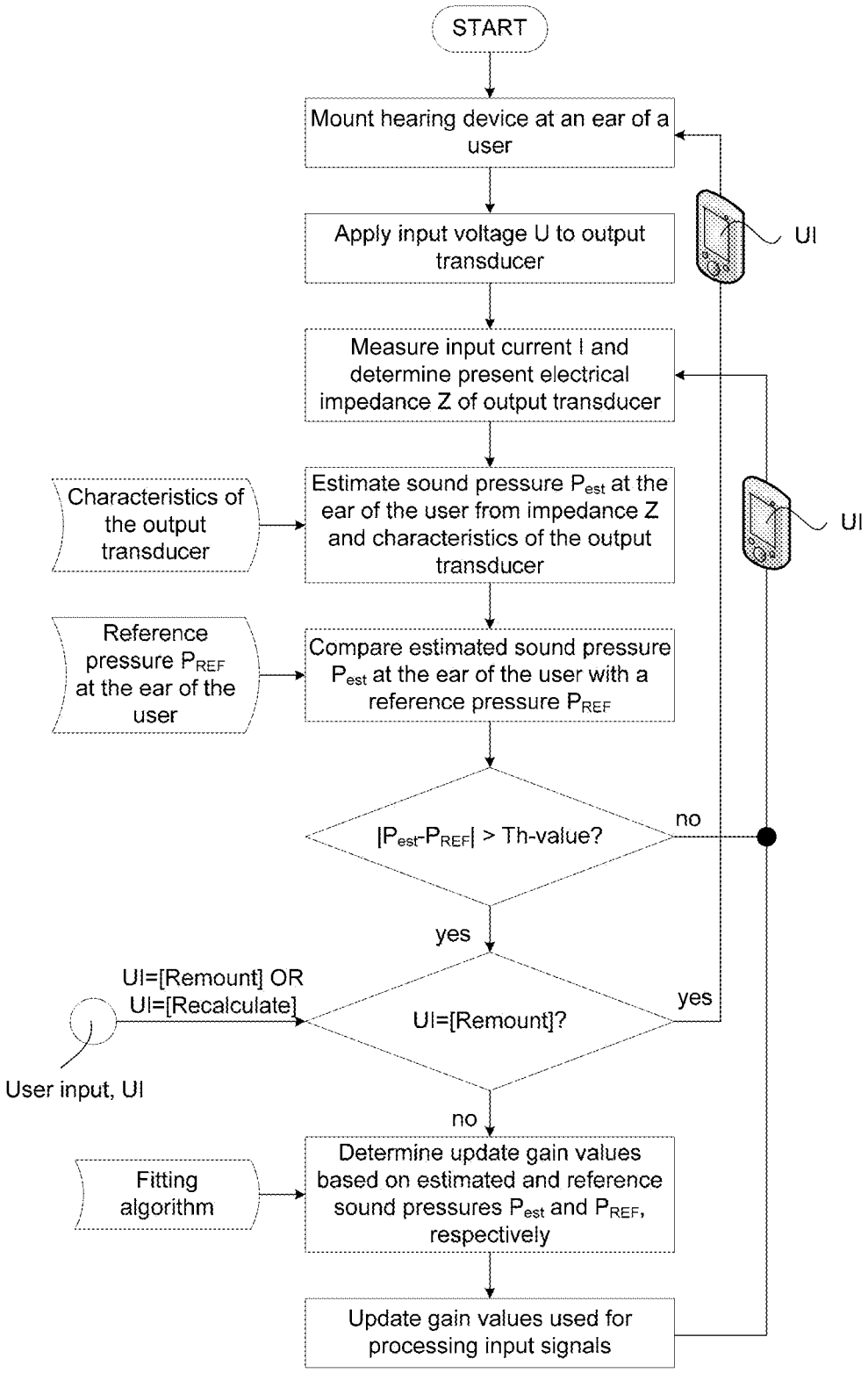
FIG. 6 shows a flow diagram representing an embodiment of a method of operating a hearing device according to the present disclosure, The figures are schematic and simplified for clarity, and they just show details which are essential to the understanding of the disclosure, while other details are left out. Throughout, the same reference signs are used for identical or corresponding parts.

FIG. 6 shows a flow diagram representing an embodiment of a method of operating a hearing device according to the present disclosure.

The general method of operating a hearing device comprises

- providing an electric input audio signal,
- processing an audio signal originating from the electric input audio signal, and providing a processed audio signal, and
  - in a normal mode of operation—using an output transducer to convert an electric output signal originating from the processed audio signal to an acoustic output sound, and
  - in a specific measurement mode—
    - using the output transducer to convert a sound pressure level to an electric signal, termed the measurement signal, and
    - determining a present electric impedance of the output transducer or a measure indicative of said present electric impedance from said measurement signal.

The embodiment of the method illustrated in FIG. 6 comprises more specific embodiments of individual steps of the general method as indicated in the flow diagram. A more specific embodiment of the method comprises one or more of the following steps, in addition to or as an embodiment of a step of the general method:

The method is started (feature START in FIG. 6) when the hearing device has been brought into a specific measurement mode of operation:

1. Mount hearing device at an ear of a user.
2. Apply input voltage U to output transducer.
3. Measure input current I and determine present electrical impedance Z of output transducer.
4. Estimate sound pressure $P_{est}$ at the ear of the user from impedance Z and characteristics of the output transducer (the latter assumed available to the method).
5. Compare estimated sound pressure $P_{est}$ at the ear of the user with a reference pressure $P_{REF}$ (the latter assumed available to the method).
6. Is the criterion $|P_{est}-P_{REF}|>$Th-value? fulfilled?
7. If no, go to step 3 (possibly provide information 'Mounting of HD OK' via a user interface, UI). If yes, go to step 8.
8. Check whether instruction from a user interface (e.g. UI in FIG. 5) to remount HD (UI=[Remount]?) has been received? (alternatively, the instruction from the user interface could be UI=[Recalculate], in which case the reaction in step 9 would be the opposite).

9. If yes, go to step 1 (possibly provide information 'Remount HD' via a user interface, UI). If no, go to step 10.
10. Determine update gain values based on estimated and reference sound pressures $P_{est}$ and $P_{REF}$, respectively (an appropriate fitting scheme assumed available to the method).
11. Update gain values used for processing input signals.
12. Go to step 3 (possibly provide information 'processing parameters updated' via a user interface, UI).

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

US2007036377A1 (STIRNEMANN, ALFRED) 15 Feb. 2007

EP2039216A1 (PHONAK) 25 Mar. 2009

[Borwick; 2001] John Borwick, Loudspeaker and Headphone Handbook, 3rd edition, Focal Press, Woburn, Mass., USA, 2001

[Schaub; 2008] Arthur Schaub, Digital hearing Aids, Thieme Medical. Pub., 2008.

[Phillippow; 1986] Eugen Philippow. (1986). *Taschenbuch Elektrotechnik*. Berlin: VEB Verlag Technik.

The invention claimed is:

1. A hearing device comprising:

an input unit for providing an electric input audio signal, a configurable signal processing unit for processing an audio signal and providing a processed audio signal, an output transducer for, in a normal mode of operation, converting an electric output signal to an acoustic output sound, a measurement unit configured, at least in a specific measurement mode, to convert a sound pressure level to an electric signal, termed the measurement signal, a memory storing a target sound pressure, or a measure thereof, intended to be applied to a user's ear drum to compensate for a hearing impairment of the user, and a control unit configured to:

determine a present electric impedance of the output transducer or a measure indicative of said present electric impedance from said measurement signal, determine an estimate of a present sound pressure based on said measurement signal and said present electric impedance of the output transducer or a measure indicative of said present electric impedance, compare said estimate of present sound pressure or a measure thereof with said target sound pressure or a measure thereof and to provide a comparison result, and determine update processing parameters for substituting presently used processing parameters in said configurable signal processing unit in dependence of the comparison result according to a predefined criterion, wherein the output transducer is reversible, the output transducer comprises a loudspeaker for providing a stimulus as an acoustic signal the user, and the loudspeaker is adapted in order to improve a reverse sensitivity compared to a sensitivity of its original purpose to ease a measurement of impedance changes.

2. A hearing device according to claim 1 further comprising a memory storing corresponding values of a specific acoustic load and the electric impedance of the output transducer when exposed to the specific acoustic load.

3. A hearing device according to claim 1, wherein the control unit is further configured to determine update processing parameters for substituting presently used processing parameters in the configurable signal processing unit based on the comparison of present electric impedance of the output transducer with an electric impedance corresponding to a specific acoustic load.

4. A hearing device according to claim 1 wherein said control unit comprises data characterizing said output transducer.

5. A hearing device according to claim 1 wherein said control unit is further configured to determine an estimate of a present sound pressure based on said measurement signal and said present electric impedance of the output transducer or a measure indicative of said present electric impedance.

6. A hearing device according to claim 1 further comprising:

a communication interface to a programming device for fitting processing parameters of the hearing device to a particular user, and wherein the hearing device is configured to allow said specific measurement mode to be controlled from said fitting system.

7. A hearing device according to claim 1 further comprising a user interface allowing said specific measurement mode to be controlled from said user interface.

8. A hearing device according to claim 1 comprising a hearing aid, a headset, an ear phone, an active ear protection systems, or a combination thereof.

9. A method of operating a hearing device, the method comprising providing an electric input audio signal, processing an audio signal originating from the electric input audio signal, and providing a processed audio signal, and in a normal mode of operation, using an output transducer in the form of a loudspeaker to convert an electric output signal originating from the processed audio signal to an acoustic output sound, and in a specific measurement mode, using the loudspeaker to convert a sound pressure level to an electric signal, termed the measurement signal, wherein the loudspeaker is adapted in order to improve a reverse sensitivity compared to a sensitivity of its original purpose to ease a measurement of impedance changes, determining a present electric impedance of the output transducer or a measure indicative of said present electric impedance from said measurement signal, determining update processing parameters from said present electric impedance, and substituting presently used processing parameters with said update processing parameters for use in said processing of the audio signal, if said estimate of present sound pressure fulfills a predefined criterion.

10. A method according to claim 9 further comprising:

analyzing said present electric impedance, providing a number of proposed actions to the use via a user interface, and allowing the user to choose an action from said number of proposed actions via said user interface.

11. A method according to claim 9 further comprising:

providing data characterizing said output transducer;

determining an estimate of a present sound pressure based on said measurement signal, said data characterizing said output transducer; and said present electric impedance of the output transducer or a measure indicative of said present electric impedance.

12. Use of a hearing device as claimed in claim 1.

13. A non-transitory computer readable medium having stored there on an application program, comprising executable instructions configured to be executed on a smartphone, or on another portable device allowing communication with said hearing device, to implement a user interface for the hearing device according to claim 1.

14. A non-transitory computer readable medium according to claim 13, wherein the application program further comprises executable instructions configured to initiate and/or present results of an acoustic load measurement in the hearing device according to claim 1.

15. A non-transitory computer readable medium according to claim 13, wherein the application program further comprises executable instructions configured to display the present estimate of loudspeaker impedance Z versus frequency as measured and estimated by the hearing device and a stored reference impedance Z versus frequency of the loudspeaker.

16. A non-transitory computer readable medium according to claim 15, wherein the application program further comprises executable instructions configured to indicate to the user that a remounting of the hearing device should be performed.

17. A non-transitory computer readable medium according to claim 15, wherein the application program further comprises executable instructions configured to allow the user to accept the present estimate of loudspeaker impedance Z and to allow the hearing device to update its processing parameters in an attempt to compensate for the differences in measured and expected impedance.

18. A hearing device according to claim 1 wherein the loudspeaker is adapted to ease the measurement of impedance changes by creating a larger change in impedance for a given change in pressure.

19. A hearing device according to claim 1 wherein the output transducer comprises a loudspeaker comprising a diaphragm.

20. A hearing device according to claim 19 wherein the diaphragm comprises graphene.

21. A method according to claim 9 implemented as part of a start-up procedure, and/or performed with a configurable frequency, and/or initiated via a user interface.

* * * * *